United States Patent [19]

Theurer et al.

[11] 4,309,846

[45] Jan. 12, 1982

[54] MOBILE MACHINE FOR REMOVING SURFACE IRREGULARITIES FROM RAIL HEADS

[75] Inventors: Josef Theurer; Klaus Riessberger, both of Vienna, Austria

[73] Assignee: Franz Plasser Bahnbaumaschinen-Industriegesellschaft m.b.H., Vienna, Austria

[21] Appl. No.: 7,424

[22] Filed: Jan. 29, 1979

[30] Foreign Application Priority Data

Feb. 10, 1978 [AT] Austria ..... 978/78

[51] Int. Cl.[3] ..... B24B 23/00

[52] U.S. Cl. ..... 51/5 B; 51/178; 409/296; 409/298; 29/33 A

[58] Field of Search ..... 51/178, 241 LG, 5 R, 51/5 B, 5 C; 409/297, 296, 298, 308, 319; 29/33 A

[56] References Cited

U.S. PATENT DOCUMENTS

| | | | |
|---|---|---|---|
| 1,025,754 | 5/1912 | Little | 51/178 |
| 1,999,943 | 4/1935 | Perazzoli | 51/178 |
| 2,741,883 | 4/1956 | Scheuchzer | 51/178 |
| 3,707,808 | 1/1973 | Danko | 51/178 |
| 4,050,196 | 9/1977 | Theurer | 51/178 |

FOREIGN PATENT DOCUMENTS

| | | | |
|---|---|---|---|
| 391146 | 3/1924 | Fed. Rep. of Germany | 51/178 |
| 1277069 | 9/1968 | Fed. Rep. of Germany | 51/178 |

*Primary Examiner*—Roscoe V. Parker
*Attorney, Agent, or Firm*—Kurt Kelman

[57] ABSTRACT

A mobile machine for removing surface irregularities from the faces of rail heads comprises a machine frame, at least one pair of tool carriers transversely aligned with respect to the track and a respective one of the tool carriers being associated with a respective one of the rails, each of the tool carriers being vertically adjustably mounted on the machine frame and arranged for guidance along the respective rail in a vertical and lateral direction, and at least one metal removing tool carried by each of the tool carriers, and at least one longitudinally adjustable spacing member extending transversely to the track between the tool carriers. A pivot connects respective ends of the spacing member to the respective tool carriers, the axes of the pivots extending preferably vertically to a plane defined by the track.

8 Claims, 6 Drawing Figures

MOBILE MACHINE FOR REMOVING SURFACE IRREGULARITIES FROM RAIL HEADS

Figure 1:
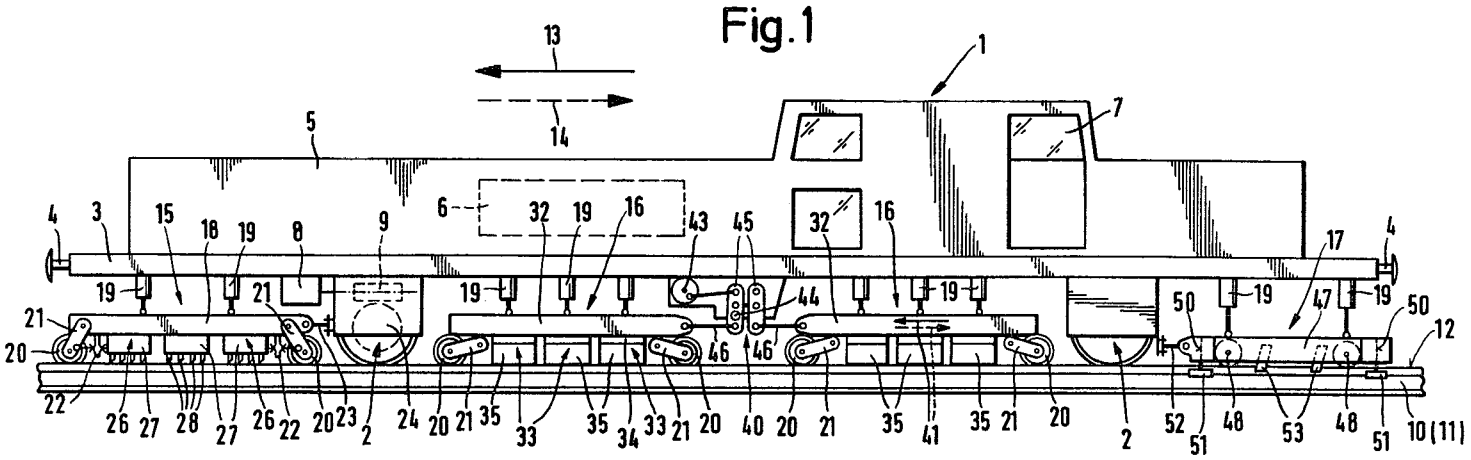

The present invention relates to improvements in a mobile machine mounted on a track for advancement therealong for removing surface irregularities from the faces of the rail heads, which comprises a machine frame and at least one pair of tool carriers substantially transversely aligned with respect to the track and a respective one of the tool carriers being associated with a respective one of the rails, each of the tool carriers being vertically adjustably mounted on the machine and arranged for guidance along the respective rail in a vertical and lateral direction, and at least one metal removing tool carried by each of the tool carriers.

U.S. Pat. No. 2,779,141, dated Jan. 29, 1957, discloses a mobile rail grinding machine wherein two wheeled trucks are mounted between the two undercarriages supporting the machine frame on the track. Each truck carries three separate, vertically adjustable grinder heads each of which comprises a grinding disc fixed to a drive shaft. Despite a complex, multi-part control for driving the disc, the metal removal obtained in each operating pass is so small that numerous passes by the machine are required to obtain the desired grinding result.

In the rail grinding machine disclosed in U.S. Pat. No. 3,738,066, dated June 12, 1973, a plurality of grinding stones are mounted on a runner and are pulled along the running face of the rail heads by the advancement of the machine along the track. This, too, requires a number of passes to achieve a smooth rail head. A similar machine is disclosed in German Pat. No. 1,021,746, published Dec. 27, 1957. Economically acceptable removal or surface irregularities from rail heads cannot be obtained with these machines.

U.S. Pat. No. 3,707,808, dated Jan. 2, 1973, discloses a mobile rail grinder with two grinding modules 15 running on flanged wheels on the track rails and being transversely aligned. The two modules are connected together by rods through ball joints to facilitate negotiation of curves. Tool carriers carrying grinding stones are mounted on each grinding module.

German Pat. No. 536,557, published Oct. 23, 1931, discloses a rail grinding car on which a pair of grinding tools is mounted for grinding a respective track rail, the two grinding tools being interconnected by transversely extending links which enable the grinding tools to be repositioned with respect to the rail heads at selected angles.

Austrian Pat. No. 221,131, published May 10, 1962, discloses a rail grinding machine wherein abrasive bands are pressed into contact with the running faces of the rail heads and the slides carrying the abrasive bands are interconnected by jacks for changing the transverse distance between the slides.

In our copending U.S. Pat. No. 4,249,346, filed Feb. 21, 1978, we have disclosed a mobile rail grinding machine which comprises a machine frame mounted on the rails of a track for continuously moving in the direction of, and along, the track, two pairs of tool carrier frames vertically adjustably mounted on the machine frame successively in the track direction and associated with the rails, a group of elongated whetstones mounted on the carrier frames for vertical adjustment to press the whetstones against surface areas of the rails to grind off surface irregularities, and a common drive connected to the pairs of carrier frames for imparting thereto reciprocatory movements in opposite senses in the track direction, which is a working movement additional to that imparted to it simultaneously by the movement of the machine frame. The tool carrier frames of each pair may be interconnected by a hydraulic jack whose ends are pivoted to the carrier frames. This arrangement has multiplied the grinding efficiency during a single pass of the machine. The entire disclosure of this application is incorporated herein by way of reference.

It is the primary object of this invention to improve mobile machine for removing the surface irregularities from the faces of rail heads in a manner designed to increase the efficiency of their operation, particularly in curving track sections.

In accordance with the invention, this object is accomplished in a mobile machine of the first-indicated type with at least one longitudinally adjustable spacing member extending transversely to the track between the tool carriers of each pair, a pivot connecting respective ends of the spacing member to the respective tool carriers, the pivots preferably extending vertically to a plane defined by the track.

Such a machine operates readily in tangent track as well as in curves and can be used universally under various conditions of wear of the rail heads to take into account different requirements of railroads. The pivotal connection of the spacing member to the tool carriers of each pair makes it possible to guide the tool carriers associated with the left and right rails accurately and clearance-free along a lateral side face of the rail heads which maintaining full relative movement of the carriers so that each tool carrier is guided along the respective rail in a vertical and lateral direction. In this manner, the operating positions of the metal removing tools on the carriers and their corresponding operating characteristics remain substantially unchanged throughout the advancement of the machine, even in sharp track curves. This makes it possible to operate even along very curvy track sections without interruption.

Figure 2:
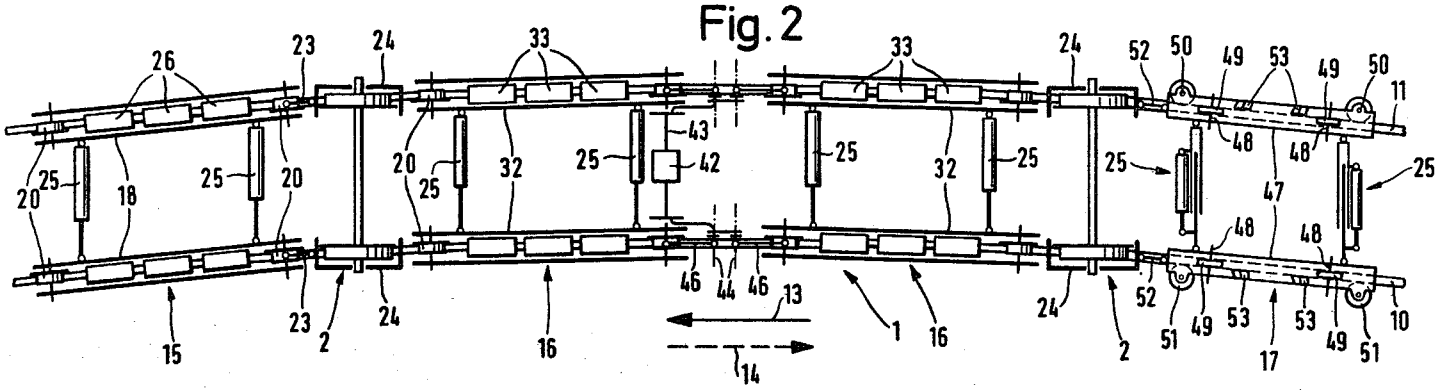
Figure 4:
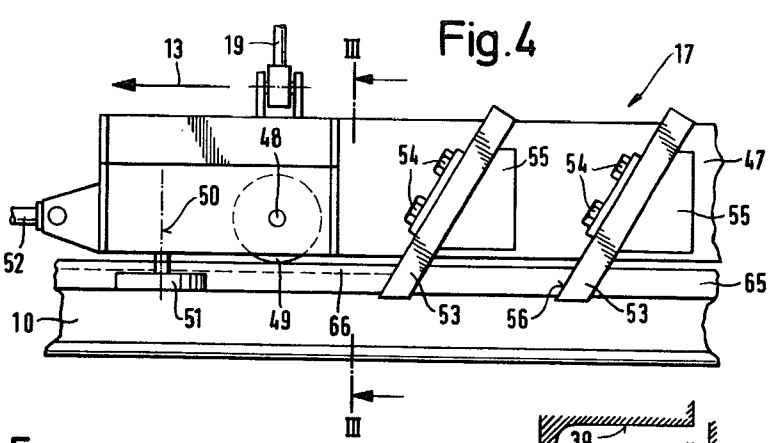
Figure 3:
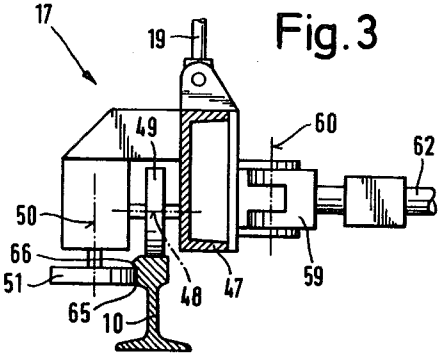
Figure 6:
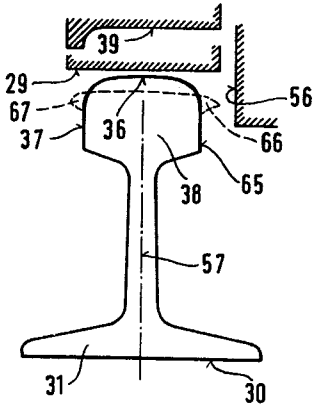
Figure 5:
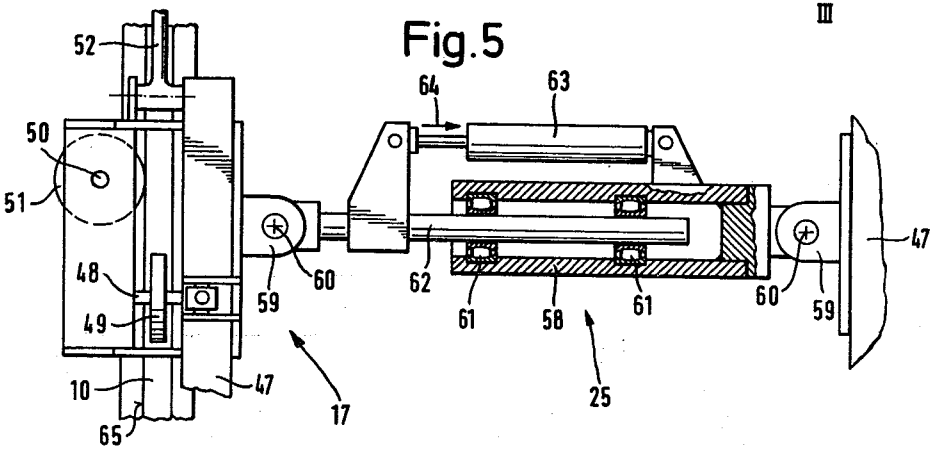

The above and other objects, advantages and features of the invention will become more apparent from the following detailed description of a now preferred embodiment thereof, taken in conjunction with the accompanying schematic drawing wherein FIG. 1 is a side elevational view of the mobile machine, FIG. 2 is a schematic top view illustrating the arrangement of the tool carriers, FIG. 3 is an enlarged sectional view along line III—III of FIG. 4, showing a detail of one of the sets of tool carriers, FIG. 4 is a partial side elevational view thereof, FIG. 5 is a top view, partly in section, of the detail illustrated in FIGS. 3 and 4, and FIG. 6 is a schematic illustration of a rail and the operation of the machine in relation thereto.

Referring now to the drawing and first to FIGS. 1 and 2, there is shown a mobile machine 1 comprising machine frame 3 comprising two undercarriages 2, 2 supporting the machine frame for advancement of machine 1 along the track in an operating direction indicated by arrow 13 or a reverse direction indicated by arrow 14. Couplings 4 at respective ends of machine frame 3 enable the machine to be incorporated as a car in a work train. Closed housing 5 is mounted on the machine frame and includes operator's cab 7, a power plant 6 being arranged in the housing to supply power to the operating tools and mechanisms of the machine, including its drive 9 connected to the power plant by transmission 8 to make the machine self-propelled. The machine moves on track 12 comprising two rails 10 and 11 each including rail head 38 having running face 36, lateral inside face 37 and lateral outside face 65, as shown in FIG. 6.

In the illustrated embodiment, three sets 15, 16 and 17 of different metal removing devices are mounted on machine frame 3 for removing surface irregularities from the faces of the rail heads. Each set comprises at least one pair of tool carriers substantially transversely aligned with respect to the track and a respective ones of the tool carriers being associated with a respective rail 10 and 11. Each of the tool carriers is vertically adjustably mounted on machine frame 3 and is arranged for guidance along the respective rail in a vertical and lateral direction. At least one metal removing tool is carried by each tool carrier.

The illustrated means for vertically adjustably mounting each tool carrier on machine frame 3 comprises at least two fluid-pressure operated jacks 19, which are preferably operated by pneumatic pressure to adjust the tool carriers vertically and to bias the tool carriers under the fluid pressure against the respective rails. Universal joints connect the jacks to the machine frame and to the tool carriers. Such a mounting for tool carriers has been disclosed in our above-mentioned copending application and asures a substantially constant, definable load on the tool carriers in tangent and curved track sections without in any way interfering with the free movement of the tool carriers in relation to their associated rails and their clearance-free guidance theralong.

The first set 15 includes a pair of tool carriers 18 each carrying metal cutting tools 28 engageable with running face 36 of rail heads 38. Such an arrangement is more fully disclosed in our copending U.S. patent application Ser. No. 968,264 filed Dec. 11, 1978, whose entire disclosure is incorporated herein by reference. Two flanged wheels 20 at respective ends of tool carriers 18 mount the tool carriers substantially without play with respect to running surface 36 and inside face 37 of the rail heads. The flanged wheels are mounted on the free ends of pivotal arms 21 for adjusting the height of the wheels, a stop 22 cooperating with the pivotal arms to maintain them in a selected annular position. Connecting rod 23 links the rear end of each tool carrier 18 to journal box 24 of front undercarriage 2 so that the tool carriers advance along the track with the machine. A succession of three cutter heads 26 are mounted on each tool carrier and each cutter head carries four detachably mounted cutting tools 28 shaped like planing knives. As shown in FIG. 6, cutting edges 29 of the cutting tools are arranged to engage the running faces of the rail head and extend substantially parallel to base plane 30 of rail base 31, preferably at an acute angle in relation to a plane perpendicular to the track, which arrangement is more fully described and illustrated in the last-mentioned application.

The second set 16 includes two pairs of tool carriers 32 each carrying metal grinding tools 33 arranged to be pressed against running faces 36 and preferably against a portion of lateral inside faces 37 of rail heads 38, as shown by cross section 39 of the grinding tools in FIG. 6. Tool carriers 32 also have two flanged wheels 20 mounted on pivotal arms 21 in the same manner as tool carriers 18. A succession of three grinding tools are mounted on each carrier 32, each grinding tool 33 being comprises of holder 34 for whetstone 35 mounted detachably in the holder. The whetstones are designed to smooth the running and lateral inside faces of the rail heads after cutting tools 28 have removed surface irregularities, such as corrugations and the like from the running faces of the rail heads. Profile 39 of the grinding tools may take any shape of obtain the desired shaping of the rail head, such as disclosed, for example, in U.S. Pat. No. 4,050,196, dated Sept. 27, 1977.

Crank drive means illustrated as common drive 40 is connected to the pairs of tool carriers 32 of second set 16 and imparts there to reciprocatory working movements in opposite directions along the rails, as indicated by arrows 41. The common crank drive is comprised of crankshaft 43 mounted on machine frame 3 and rotated by motor 42, the crankshaft being connected to two rocking levers 45 associated with each rail for rocking the levers back and forth, a respective push rod 46 connecting each of the tool carriers to one of the rocking levers to produce the reciprocatory working movements of tool carriers 32, which arrangement is more fully described and illustrated in our first-mentioned patent application.

The third set 17 includes a pair of tool carriers 47 and metal shearing tools 53 carried by the tool carriers for engagement with lateral outside faces 65 of the rail heads.

In accordance with the present invention, at least one longitudinally adjustable spacing member 25 extends transversely to track 12 between tool carriers 18, 32 and 47 of each pair. A pivot connects respective ends of spacing members 25 to the respective tool carriers for free movement of the tool carriers with respect to the spacing members along the rails with which they are associated. This arrangement permits the simultaneous or selective use of cutting, grinding and shearing tools in the shaping and smoothing of rail heads as the machine advances along the track, particularly the successive coarse and fine machining of rail head surfaces with the use of the cutting and shearing tools in a first pass in the direction of arrow 13 and the subsequent smoothing of the machined rail head surfaces with the grinding tools in a reverse pass in the direction of arrow 14. This operation is very economical because the speed best suited to the respective work can be maintained during each pass of the machine along the track section and high working speeds may be obtained while protecting the operating life of the metal removing tools to the utmost. Equipping the machine with the third set providing metal shearing tools makes it possible to meet the requirement of some railroads for not only removing surface irregularities from the rail heads due to wear but also to remove the bulges created at the lateral faces of the rail heads by the wheels of the trains rolling over the rails. This is particularly advantageous if previously laid rails are re-used because when such rails are re-laid at opposite sides of the track, they will thus have a machined surface in contact with the flanged train wheels.

As more clearly shown in FIG. 3, pairs of guide rollers 49, 51 on tool carriers 47 of third set 17 respectively engage running faces 36 and lateral outside faces 65 of rail heads 38 for clearance-free guidance of the tool carriers along rails 10 and 11. Guide rollers 49 are rotatable about horizontal axles 48 extending transversely to the track and guide rollers 51 are rotatable about vertical axles 50. Connecting rod 52 links the forward end of each tool carrier 47 to the journal box of rear undercarriage 2 so that the tool carriers advance with the machine.

Spacing members 25 include adjustment drives for longitudinally adjusting the spacing members, the illustrated adjustment drives being fluid-pressure operated jacks. The adjustment drives for the spacing members between tool carriers 18 and 32 are operable in one direction, i.e. fluid pressure is applied to the jacks so as to press flanged wheels 20 against inside faces 37 of the rail heads, while the adjustment drives for the spacing members between tool carriers 47 are operable in the opposite direction, i.e. fluid pressure is applied to the jacks so as to press guide rollers 51 against outside faces 65 of the rail heads (see FIG. 3).

As shown in FIG. 1, second set 16 of tamping tool carriers 32 is mounted on machine frame 3 between undercarriages 2 while the pairs of tool carriers 18 and 47 of the first and third sets 15 and 17 are mounted on end portions of the machine frame overhanging the undercarriages.

The above-described arrangement of the adjustment drives for the spacing members assures a clearance-free guidance of all the tool carriers along the rails, regardless of the track guage and changes therein. Care must be taken that guide rollers 51 are arranged so that they press against the lower portions of outside faces 65 which are not deformed so as to assure an accurate reference for shearing tools 53 and to avoid the possibility that these tools are so positioned as to copy the existing bulges created by the cold deformation of the rail heads by the wheels of passing trains. The illustrated arrangement of the three successive sets 15, 16 and 17 of different metal removing tools makes full and space-saving use of all the room available below the machine frame, thus reducing the length of the machine. At the same time, all the tool carriers are independently guided along the rails and move only slightly relative to machine frame 3, even in sharp curves. This produces very favorable conditions for transmitting drive, load, tensile and pressure forces from the machine frame to the tool carriers.

As best shown in FIG. 4, tool carriers 47 of third set 17 carry two metal shearing tools 53 spaced from each other in the direction of the rails, each shearing knife 53 being detachably and adjustably mounted on holders 55 by a pair of set screws 54. In this manner, the shearing tools are adjustable for different cutting depths with respect to the rails, their cutting edges 56 extending substantially parallel to vertical plane of symmetry 57 of the rails, as shown in FIG. 6 and the shearing tools themselves extending obliquely relative to a plane defined by the track and enclosing an acute angle therewith. Distributing the shearing forces over more than one tool not only increases the operating life of the shearing tools but also improves the quality of shearing.

As illustrated in FIG. 5, in a preferred embodiment, spacing members 25 for tool carriers 47 each comprises housing 58 extending transversely to track 12 and connecting rod 62 axially movably and pivotally mounted in the housing. Housing 58 is pivotally connected to one of the tool carriers at pivot 59 to enable the housing to pivot about vertical axis 60 and rod 62 is pivotally connected to the other tool carrier in the same manner. Self-aligning bearing means consisting of pivotal bearings 61 pivotally guide and support connecting rod 62 in housing 58. The adjustment drive for the spacing members comprises cylinder 63 and a piston rod slidable therein, the cylinder being linked to the housing and the piston rod being linked to the connecting rod. By supplying pressure fluid to the piston in the direction of arrow 64, guide rollers 51 are moved into clearance-free engagement with outside face 65 of rails 10 and 11, as shown in FIG. 3.

In this arrangement, the spacing member constitutes the guide part for the longitudinally adjustable spacing of the two opposite tool carriers while the adjustment drive does not have to absorb any of the guide forces. The pivotal mounting of connecting rod 62 in housing 58 of the spacing member makes it possible for the spacing member to be tilted so that the two opposite tool carriers may be positionally adjusted in track superelevations where one rail is higher than the other.

FIG. 6 shows an end view of a conventional rail in new condition, in full lines. As the rail becomes progressively worn by a succession of trains rolling thereover, the rail head is deformed in a manner generally indicated by the broken lines indicating depressions, corrugations or like surface irregularities in running face 36 and bulges 66 and 67 at the lateral faces 37 and 65 of rail head 38. All of these surface irregularities are removed by operation of the three sets of metal removing tools provided on the machine, as hereinabove described.

At the beginning of the operation, the track section is first subjected to coarse machining. For this purpose, jacks 19 are actuated to lower tool carriers 18 and 47, and the adjustment drives are actuated to adjust spacing members 25 longitudinally until flanged wheels 20 and guide rollers 49, 51 are in clearance-free engagement with rails 10 and 11. After the cutting depth of tools 28 and 53 has been suitably adjusted, fluid pressure is applied to jacks 19 until a desired vertical pressure has been applied to the tool carriers to press the tools into engagement with the rail heads.

With tools 28 and 53 thus in working position and with tool carriers 32 remaining in their raised or inoperative position, drive 9 is actuated to advance machine 1 continuously along track 12 in the direction of arrow 13 at a speed of about 4 to 6 km/h. During this pass, undulations and other irregularities are coarsely removed from running face 36 of rail heads 38 by cutting tools 28 while shearing knives 53 simultaneously remove bulges 66 from lateral outside faces 65. At the end of the track section on which work is to be done, machine 1 is stopped, the adjustment drives are actuated to disengage the flanges wheels and guide rollers from the rails and jacks 19 are actuated to raise the tool carriers to their inoperative positions. Tool carriers 32 are now lowered and their flanged wheels are brought into engagement with the rails. With the grinding tools pressed against the rail heads, motor 42 is actuated to impart reciprocatory movements to the tool carriers while the operating direction of machine 1 is reversed (see arrow 14), the machine being advanced at a reduced speed of about 1 km/h to grind the rail head faces smooth, the grinding stones with their profiles 39 also removing at least part of bulges 67 on the inside face of the rail heads.

If desired, this smoothing operation may be followed by a subsequent grinding pass to increase the smoothness of the rail head surfaces, the entire operation being very effective in producing high-quality surfacing of the rail heads while assuring a most economical production. If desired, all three sets of metal removing tools may be operated at the same time in a single operating pass while each set may be operated singly, if conditions warrant.

What is claimed is:

1. A mobile machine mounted on a track for advancement therealong, the track comprising two rails each including a head having a running face, a lateral inside face and a lateral outside face, for removing surface irregularities from the faces of the rail heads, which comprises (a) a machine frame, (b) three sets of pairs of tool carriers, the tool carriers of each pair being substantially transversely aligned with respect to the track and a respective one of the tool carriers being associated with a respective one of the rails, (1) each of the tool carriers being independently vertically adjustably mounted on the machine frame and arranged for independent movement and guidance along the respective rail in a vertical and lateral direction, (2) a first one of the sets including one of said pairs of tool carriers and at least one metal cutting tool engageable with the running faces of the rail heads carried by the tool carriers of the first set, (3) a second one of the sets including at least one other pair of tool carriers and at least one metal grinding tool arranged to be pressed against the running faces of the rail heads carried by the tool carriers of the second set, and (4) a third one of the sets including a third pair of tool carriers and at least one metal shearing tool engaging with the lateral outside faces of the rail heads, and (c) at least one longitudinally adjustable spacing member extending transversely to the track between the tool carriers of each pair, (1) a pivot connecting respective ends of the spacing member to the respective tool carriers, the axes of the pivots extending vertically to a plane defined by the track.

2. The mobile machine of claim 1, wherein the tool carriers of the third set carry at least two of said metal shearing tools spaced from each other in the direction of the rails, the shearing tools being adjustable for different cutting depths with respect to the rails.

3. The mobile machine of claim 1, further comprising at least two-fluid pressure operated jacks vertically adjustably mounting the tool carriers on the machine frame, the jacks vertically biasing the tool carriers under the fluid pressure, and universal joints connecting the jacks to the machine frame and to the tool carriers.

4. The mobile machine of claim 3, wherein the fluid pressure is pneumatic pressure.

5. A mobile machine mounted on a track for advancement therealong, the track comprising two rails each including a head having a running face, a lateral inside face and a lateral outside face, for removing surface irregularities from the faces of the rail heads, which comprises (a) a machine frame, (b) three sets of pairs of tool carriers, the tool carriers of each pair being substantially transversely aligned with respect to the track and a respective one of the tool carriers being associated with a respective one of the rails, (1) each of the tool carriers being independently vertically adjustably mounted on the machine frame and arranged for independent movement and guidance along the respective rail in a vertical and lateral direction, (2) a first one of the sets including one of said pairs of tool carriers and at least one metal cutting tool engageable with the running faces of the rail heads carried by the tool carriers of the first set, (3) a second one of the sets including at least one other pair of tool carriers and at least one metal grinding tool arranged to be pressed against the running faces of the rail heads carried by the tool carriers of the second set, (4) flanged wheels on the tool carriers of the first and second sets, the flanges of the wheels engaging the lateral inside faces of the rail heads for clearance-free guidance of the tool carriers along the rails, (5) a third one of the sets including a third pair of tool carriers and at least one metal shearing tool engaging with the lateral outside faces of the rail heads, (6) pairs of guide rollers on the tool carriers of the third set, the guide rollers of each pair respectively engaging the running faces and lateral outside faces of the rail heads for clearance-free guidance of the tool carriers along the rails, (c) at least one longitudinally adjustable spacing member extending transversely to the track between the tool carriers of each pair, (1) a pivot connecting respective ends of the spacing member to the respective tool carriers, the axes of the pivots extending vertically to a plane defined by the track, and (d) adjustment drives for the spacing members for longitudinally adjusting the spacing members, the adjustment drives for the spacing members between the tool carriers of the first and second sets being operable in one direction and the adjustment drive for the spacing member between the tool carriers of the third set being operable in a direction opposite to the one direction.

6. A mobile machine mounted on a track for advancement therealong, the track comprising two rails each including a head having a running face, a lateral inside face and a lateral outside face, for removing surface irregularities from the faces of the rail heads, which comprises (a) a machine frame, (b) two undercarriages supporting the machine frame for advancement of the machine along the track, (c) three sets of pairs of tool carriers, the tool carriers of each pair being substantially transversely aligned with respect to the track and a respective one of the tool carriers being associated with a respective one of the rails, (1) each of the tool carriers being independently vertically adjustably mounted on the machine frame and arranged for independent movement and guidance along the respective rail in a vertical and lateral direction, (2) a first one of the sets including one of said pairs of tool carriers and at least one metal cutting tool engageable with the running faces of the rail heads carried by the tool carriers of the first set, (3) a second one of the sets including two pairs of tool carriers, at least one metal grinding tool arranged to be pressed against the running faces of the rail heads carried by the tool carriers of the second set, and crank drive means connected to the pairs of tool carriers of the second set and imparting thereto reciprocatory working movements in opposite directions along the rails, (4) a third one of the sets including a third pair of tool carriers and at least one metal shearing tool engaging with the lateral outside faces of the rail heads, the pairs of tool carriers of the first and third sets being mounted on end portions of the machine frame overhanging the undercarriages, and (5) connecting rods for attaching the tool carriers of the first and third sets to the machine frame for advancement therewith, and (d) at least one longitudinally adjustable spacing member extending transversely to the track between the tool carriers of each pair, (1) a pivot connecting respective ends of the spacing member to the respective tool carriers, the axes of the pivots extending vertically to a plane defined by the track.

7. A mobile machine mounted on a track for advancement therealong, the track comprising two rails each including a head having a running face, a lateral inside face and a lateral outside face, for removing surface irregularities from the faces of the rail heads, which comprises (a) a machine frame, (b) at least one pair of tool carriers substantially transversely aligned with respect to the track and a respective one of the tool carriers being associated with a respective one of the rails, (1) each of the tool carriers being independently vertically adjustably mounted on the machine frame and arranged for independent movement and guidance along the respective rail in a vertical and lateral direction, and (2) at least one metal removing tool carried by each of the tool carriers, (c) at least one longitudinally adjustable spacing member extending transversely to the track between the tool carriers, each spacing member comprising (1) a housing extending transversely to the track and (2) a connecting rod axially movable and pivotally mounted in the housing, (3) a pivot connecting the housing to one of the tool carriers of each pair and another pivot connecting the connecting rod to the other tool carrier of the pair, the axes of the pivots extending vertically to a plane defined by the track, and (d) an adjustment drive coupled to each spacing members for longitudinally adjusting the spacing member, the adjustment drive comprising (1) a cylinder element and a piston rod element slidable therein, one of the elements being linked to the housing and the other element being linked to the connecting rod.

8. The mobile machine of claim 7, further comprising self-aligning bearing means pivotally guiding the connecting rod in the housing.

* * * * *